US005784918A

United States Patent [19]

Shao-Chien

[11] Patent Number: 5,784,918

[45] Date of Patent: Jul. 28, 1998

[54] METHOD AND APPARATUS FOR SWAGING METALLIC EMBOSSED PIPES

[76] Inventor: Tseng Shao-Chien, No. 130 Sec 2, Yang-Shin Rd., Yang-Mei Taoyuan 326, Taiwan

[21] Appl. No.: 812,261

[22] Filed: Mar. 6, 1997

[51] Int. Cl.[6] ..... B21D 15/04

[52] U.S. Cl. ..... 72/370.04; 29/423; 72/370.2

[58] Field of Search ..... 72/76, 306, 367, 72/370, 398, 401, 402, 404, 370.04, 370.2; 29/423

[56] References Cited

U.S. PATENT DOCUMENTS

| | | | |
|---|---|---|---|
| 1,713,818 | 5/1929 | Cotton | 29/423 |
| 4,102,173 | 7/1978 | Saloom | 72/306 |

*Primary Examiner*—Lowell A. Larson

*Attorney, Agent, or Firm*—Pro-Techtor International Services

[57] ABSTRACT

A method and an apparatus for swaging a metallic embossed pipe to form concavities in its wall units, wherein, a die core made from a holding pipe having surface meshes and a plastisol filler is provided in the metallic pipe mounted in a circularly swaging apparatus having two positioning seats respectively movably provided on two ends of a slide way and can absorb swaging pressure exerted on the pipe wall, some swage processing seats movably provided between the positioning seats clamp the embossed pipe and position it accurately in an axis line; the processing seats press synchronically inwardly in a radiant array to swage the embossed pipe, thus the concaved pipe wall units are formed, the pipe hole and the die core are then slightly heated to draw the holding pipe and plastisol out to complete the process for swaging and forming the concaved wall units.

5 Claims, 4 Drawing Sheets

2—2

3—3

METHOD AND APPARATUS FOR SWAGING METALLIC EMBOSSED PIPES

BACKGROUND OF THE INVENTION

1. Field of the Invention

The present invention relates to a method and an apparatus for forging metallic pipes, and especially to a method and an apparatus for swaging metallic pipes to form concavities in a plurality of wall units thereof, wherein, the metallic pipes having had relief on their walls already are swaged on the wall units in cicular discontinuity.

2. Description of the Prior Art

In the existing swaging techniques, metallic pipes to be swaged to have embossment are mostly processed by a rotary swager, a stationary-spindle swager, a creeping-spindle swager, an alternate-blow swager or a die-casting swager, etc., metallic pipes formed step by step by such existing swaging techniques have their surface embossment swaged in circular continuity, such as is shown by the pipe A in FIG. 1, all the concaves and convexes are distributed around the periphery of the pipe, therefore, the metallic pipes formed by such process technique are called "embossed pipes".

The metallic embossed pipes made by the aforementioned swaging techniques are provided with high compressive strength, and is used normally on rails of a stairway, gate tubes for metallic doors, pipe frames for exhibition pipe legs for tables and chairs etc., contour of the pipes can also be formed by the above stated swaging technique in pursuance of practical requirement, circular continuity of the contour determines the given shape of the embossment of the embossed pipe; based on this, the embossment of the embossed pipe is further processed to form the concaved units in cicular discontinuity, the above stated swaging technique can not effect this, especially in the case of the B pipe shown in FIG. 1, the surface of the embossed pipe is formed inwardly various units of concaved portions of specified standards (i.e., the concaved wall portions of the present invention), these concaved wall portions are varied in pursuance of the variation of the inner and the external walls, however, the above stataed known swaging technique can not effect this, the only possible feasible technique might be the metallic forging technique which might make an embossed pipe having the concaved units in circular discontinuity; it is also known that the metallic articles made by forging technique have looser grain structure, hence its compressive strength is inferior, the surfaces of the metallic articles made are coarser and need further grinding, such metallic articles often leave pin holes thereon, quality thereof is very bad and therefore lowers value of art thereof, when in casting, the equipments for manufacturing a die and die cores and equipments for casting from a melting furnace are very expensive, this is well known by persons in the art, therefore, the motive of the present invention is to form the concaved units in circular discontinuity with high strenth on the pipe wall of a metallic embossed pipe by swaging.

SUMMARY OF THE INVENTION

The main object of the present invention is: providing a method and an apparatus to swage synchronically on a plurality of wall units of an embossed pipe, wherein, pressure for swaging is exerted from several positions outside of and around the pipe concentrically toward the center; a die core capable of absorbing swaging pressure from all the wall units of the pipe and a circularly swaging apparatus are used, the apparatus can check the position of the pipe and adjust the orientations and angular positions of the swaging force to be exerted on the units to be swaged, strength of the embossed pipe thus can be enhanced, the circularly swaging apparatus can also be used to form various concaved patterns and to process pipes in different angular positions, in this way, area of application of the metallic pipe wall swaging and processing technique can be enlarged.

To achieve the above stated objects, the present invention is provided with the following technical characteristics:

1. Hot plastisol is used as a mouldable filler, it can be easily poured into the pipe hole to a fully filled state, such that when the plastisol is cooled and condensed, it can adequately bear the swaging pressure exerted on the pipe wall units, and it can accept slight heat conduction after swaging to render the plastisol to be separated from the surface of the wall contacting therewith, so that the die core can be taken out easily without damage to the embossed pipe wall.
2. A holding pipe made of metal is used as a supporting axle pipe for the die core, meshes are provided all over the pipe wall of the holding pipe, the meshes are communicated with the central pipe hole of the holding pipe, a plastic film is sticked on the external wall of the holding pipe, when the plastisol is filled between the plastic film on the external wall of the holding pipe and the wall of the embossed pipe hole, melting temperature of the hot plastisol renders the plastic film to be molten together therewith, thereby the plastic film prevent the hot plastisol from flowing into the central pipe hole through the meshes during lowering of temperature and condensation of the plastisol, the central pipe hole forming the holding pipe is hollow, so that when the wall units of the embossed pipe bear the swaging pressure, this solid plastisol having been condensated but still being soft will be pressed toward the central pipe hole of the holding pipe, and thereby form a die core which can absorb the swaging pressure and eliminate it in the central pipe hole of the holding pipe.
3. A slide way provided on a platform of the circularly swaging apparatus is used, two positioning seats are respectively movably provided on the two ends of the slide way, distance between the positioning seats can be adjusted automatically depending on the length of an embossed pipe to be swaged; besides, the oil pressure chucks provided on the two positioning seats can accurately clamp the pipe to be swaged in positions in alignment in an axis line.
4. An appropriate amount of swage processing seats are movably provided between the two positioning seats at the two ends of the slide way of the circularly swaging apparatus, these processing seats are capable of automatically adjusting the spaces therebetween, on the processing seats, a plurality of punching heads for the oil pressure cylinders and the plug rods are provided radiately around the periphery of the pipe equidistantly to the neighboring punching heads, thereby an embossed pipe within a larger range of various diameters can be placed in the surrounding of the punching heads for swaging on the concaved units to be swaged.
5. An appropriate amount of oil pressure punching heads are provided on the swage processing seats and are arranged to press inwardly in a radiant style, so that when the wall units of the pipe are pressed by swaging pressure, they can bear uniform swaging pressure in each normal direction to each unit wall respectively; the pipe body portions adjacent to the wall units being swaged thus can be gotten rid of unnecessary conponent of forces in all the non normal directions, so that the pipe wall portions adjacent to the concaved wall units can be prevented from unnecessary deformation. in this way, the concaved wall units can have smooth curves at their turning angles.

The present invention will be further described in detail in respect to the above stated objects and characteristics by the detailed description of the preferred embodiments thereof in reference to the accompanying drawings.

DETAILED DESCRIPTION OF THE PREFERRED EMBODIMENT

Figure 1:
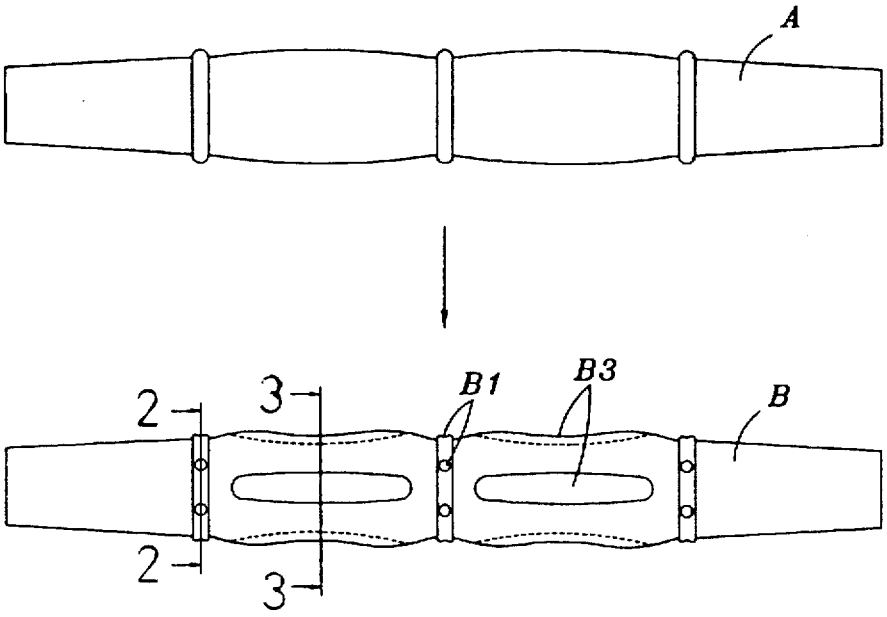
FIG. 1 is a schematic view showing a conventional embossed metallic pipe is formed into a pipe having a plurality of units with further processed concavities by the present invention.
Figure 2:
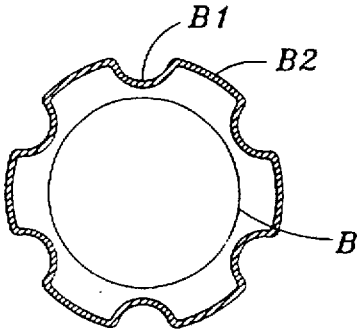
FIG. 2 is an enlarged sectional view taken from the sectional line C-C' of FIG. 1 showing the first embodiment of concaved pipe wall portion formed by the process of the present invention on an embossed metallic pipe.
Figure 3:
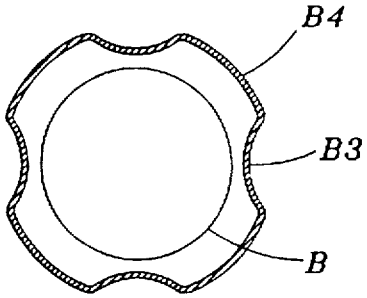
FIG. 3 is an enlarged sectional view taken from the sectional line D-D' of FIG. 1 showing the second embodiment of concaved pipe wall portion formed by the process of the present invention on an embossed metallic pipe.

As shown in FIG. 1, the present invention uses a swaged embossed pipe (such as the A pipe) as a work piece which, according to the positions of the concaved pipe wall units (B1 or B3) to be formed, is capable of being swaged by a circularly swaging apparatus 2 (to be described in detail herein after) synchronically on the wall units, thus forms the concaved Wall units as shown on the B pipe; wherein, we can see from the sectional view C-C' in FIG. 1 and 2 the first style respectively independent concaved pipe wall units B1 of the present invention distributed equidistantly around the pipe, each concaved wall unit B1 is formed by swaging between the adjacent arciform pipe wall portions B2, while these arciform pipe wall portions B2 not being swaged still maintain their original curvature, obviously they are not influenced by deformation of the concaved pipe wall units B1 formed transiently by swaging, this is the effect created by the mutual swaging effects of the die core 1 and the circularly swaging apparatus 2 to be described hereinafter. Further refer to the sectional line D-D' of FIG. 1 and FIG. 3 which show the second embodiment of concaved pipe wall portion having the independent concaved wall units B3 distributed equidistantly around the pipe, the concaved wall units B3 are formed between the adjacent wider arciform pipe wall portions B4, while these arciform pipe wall portions B4 not being swaged are not influenced by swaging of the concaved pipe wall units B3 near them, therefore, the original curvature thereof can be maintained.

Figure 4:
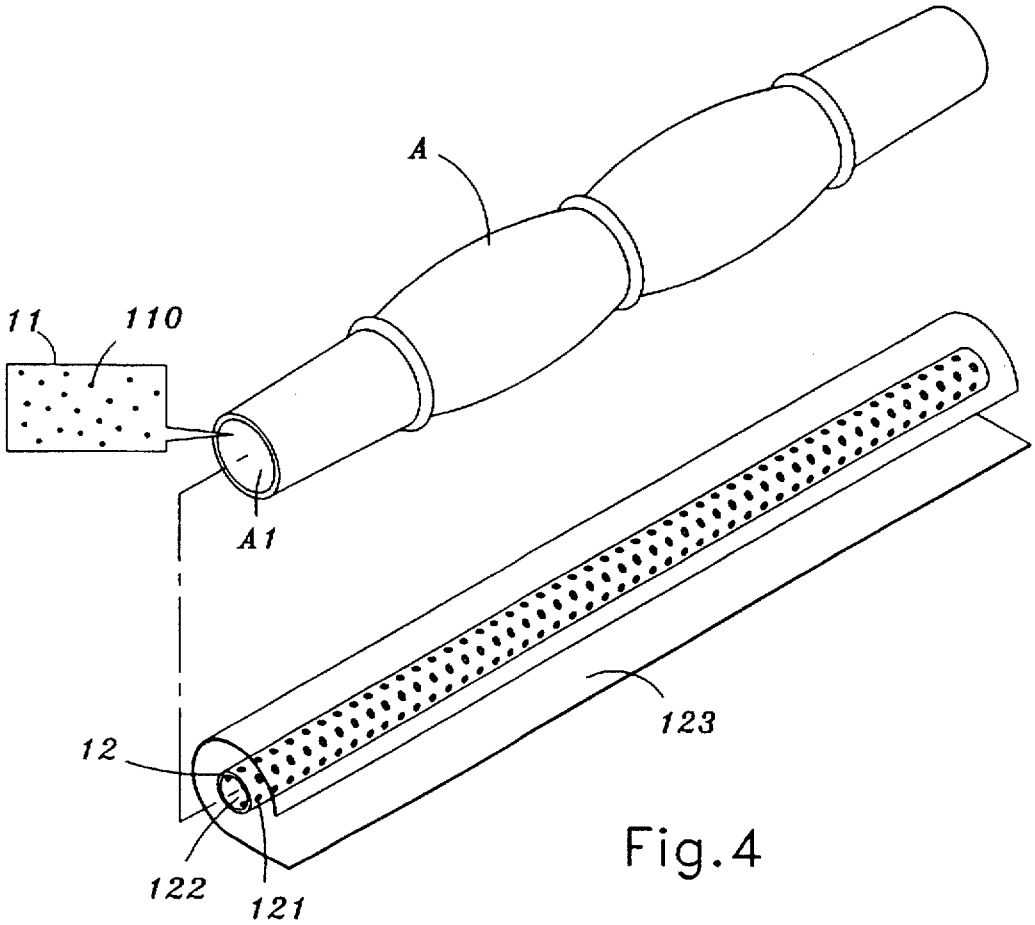
FIG. 4 is a schematic view showing assembling of a die core which is loaded in the pipe hole of an embossed pipe of the present invention.
Figure 5:
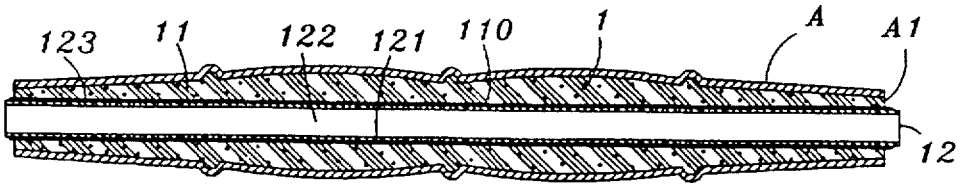
FIG. 5 is a sectional view showing a die core as shown in FIG. 4 having been loaded in the embossed pipe of the present invention.

Before using of the above mentioned A pipe in the present invention, the die core 1 must be placed in the pipe hole A1 thereof, such as is shown in FIG. 4, the die core 1 used in the present invention is constructed from the hot plastisol 11 and a holding pipe 12 made of metal, wherein, the pipe body of the holding pipe 12 is provided all over it with a lot of meshes 121 which are communicated with the central pipe hole 122 of the holding pipe 12, as shown in FIG. 4 and 5, before filling in the die core 1, a plastic film 123 shall cover the holding pipe 12, the holding pipe 12 covered with the plastic film 123 then is extended into the pipe hole A1 of the embossed pipe A, and melt the plastisol 11 into liquid plastics at its melting point (about 70 to 80 degrees centigrade) and cast it into the relieved wall of the embossed pipe A, the plastic film 123 is thereby melted to cover all the meshes 121, so that the melted plastisol 11 will not flow into the meshes 121 during casting, and the central pipe hole 122 of the holding pipe 12 can be left in a hollow state, when the melted-plastisol 11 is condensed, it can be used as a filler for the die core 1 in the pipe hole Al of the embossed pipe and has excellent plasticity suitable for extension and deformation thereof.

The plastisol 11 in the die core 1 can be mixed with silicon sand, iron sand or steel balls with smaller grainularity relative to the size of the meshes 121 and used as additives 110, so that when the plastisol 11 is condensed into solid state, it can contain these additives 110 to form a filler for the die core 1 having higher compressive strength.

Figure 6:
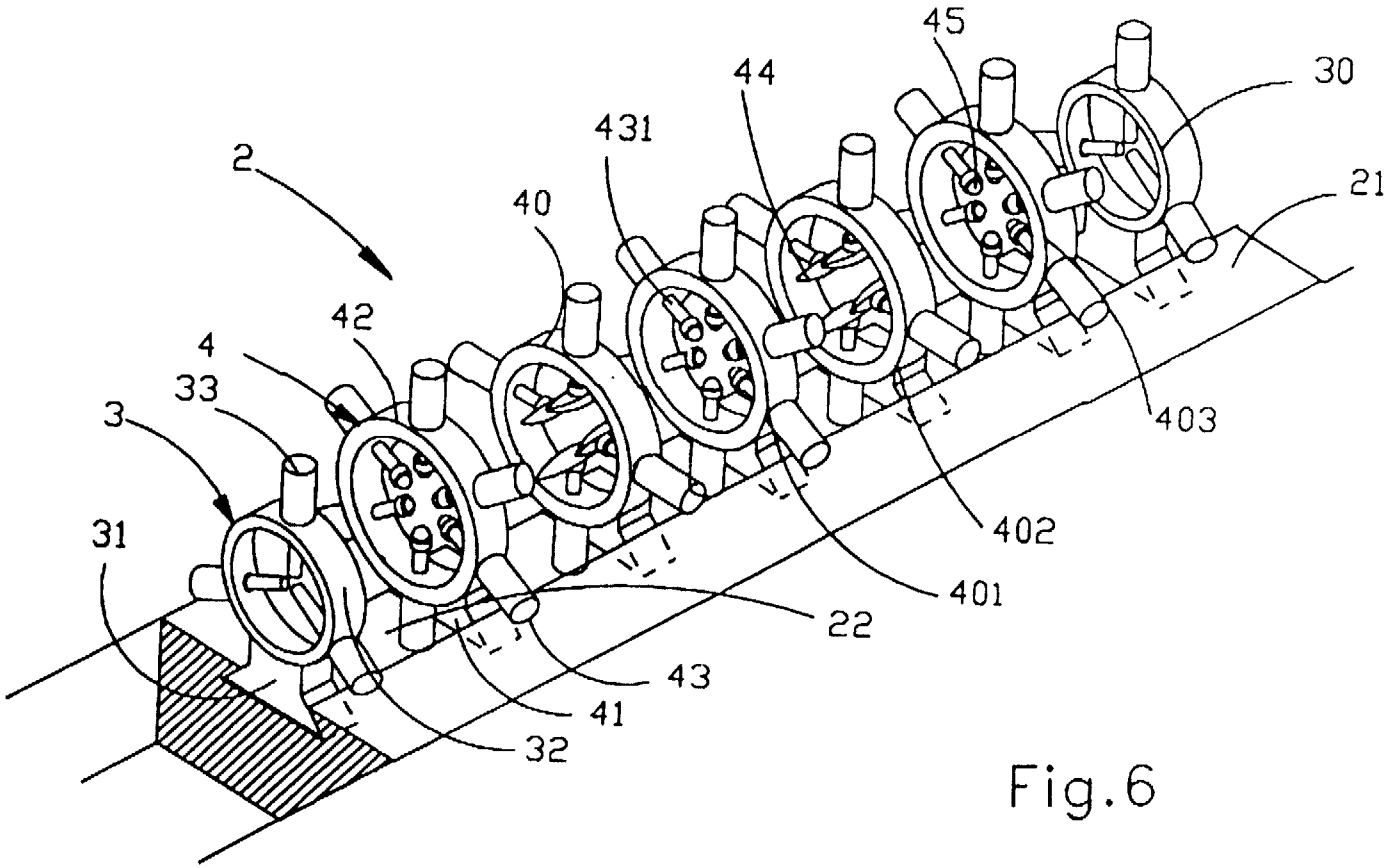
FIG. 6 is a perspective view showing the structure of a circularly swaging apparatus of the present invention.

As shown in FIG. 6, the embossed pipe A having filled therein the die core 1 must be swaged by the circularly swaging apparatus 2 for forming the concaved pipe wall units B1 and B3; the circularly swaging apparatus 2 can be provided with a slide way 22 on a platform 21 thereof, two positioning seats 3 and 30 are respectively movably provided on the two ends of the slide way 22, an appropriate amount of swage processing seats 4, 40, 401, 402 and 403 are movably provided in the slide way 22 between the two positioning seats 3, 30, a screw or oil pressure cylinder can be provided in the slide way 22 (this is the known structure for transmitting, and is not depicted nor narrated herein) to be used for controlling adjustment of position of each of various embossed pipes A which is clamped between the positioning seats 3, 30, relative distances between the adjacent swage processing seats 4, 40, 401, 402 and 403 required for adjustment of positions thereof for swaging are controlled by this positioning and transmitting measures.

Now the processing seat 3 at one end is taken for describing its structure components, the bottom of the processing seat 3 is made to be able to engage a slide seat 31 in the slide way 22, the slide seat 31 and the slide way 22 can be made to be matchable such as in the form of a dove tail member and a slide groove respectively as is the case of the present embodiment, or can be in the form of some other matchable square or rectangular member and groove; the body of the slide seat 31 is engaged with an annular portion 32 on which a plurality of circumbiently distributed oil pressure punching heads 33 pressing inwardly are provided in a radiant array, by this, the processing seats 3, 30 at the ends can clamp one of the embossed pipes A of various specifications and position it accurately in alignment with an axis line.

Further, the swage processing seat 4 is taken for describing its structure components, the bottom of the swage processing seat 4 is also made to be able to engage a slide seat 41 in the slide way 22, the slide seat 41 and the slide way 22 can be made to be matchable such as in the form of a dove tail member and a slide groove respectively as is the case of the present embodiment, or can be in the form of some other matchable square or rectangular member and groove; the body of the slide seat 41 is also provided with an annular portion 42 on which a plurality of circumbiently distributed oil pressure cylinders 43 pressing inwardly are provided in a radiant array, the leading ends of the plug rods 431 of the oil pressure cylinders 43 can be provided with punching heads 44 or 45 according to the shape of the concaved pipe wall units B1 or B3 to be formed by swaging, in this way, an embossed pipe B having a plurality of independent concaved pipe wall units B1 or B3 made by sychronical swaging by all the oil pressure cylinders 43 can be formed.

Figure 7:
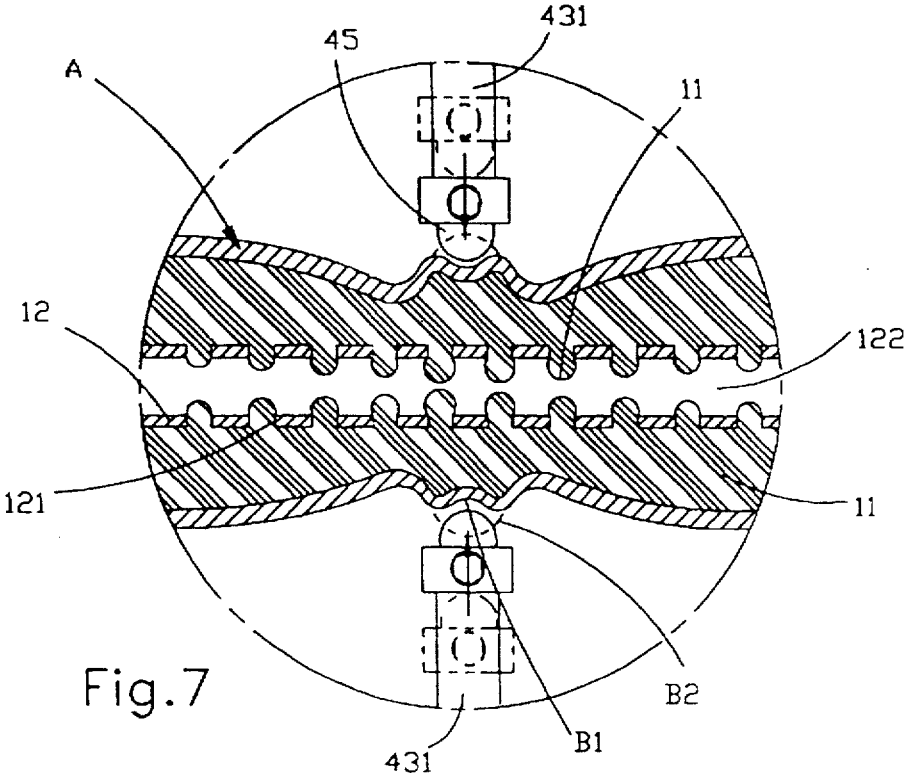
FIG. 7 is an enlarged sectional view showing the first style embossed pipe wall units of the present invention being swaged by the oil pressure punching head of the circularly swaging apparatus.
Figure 8:
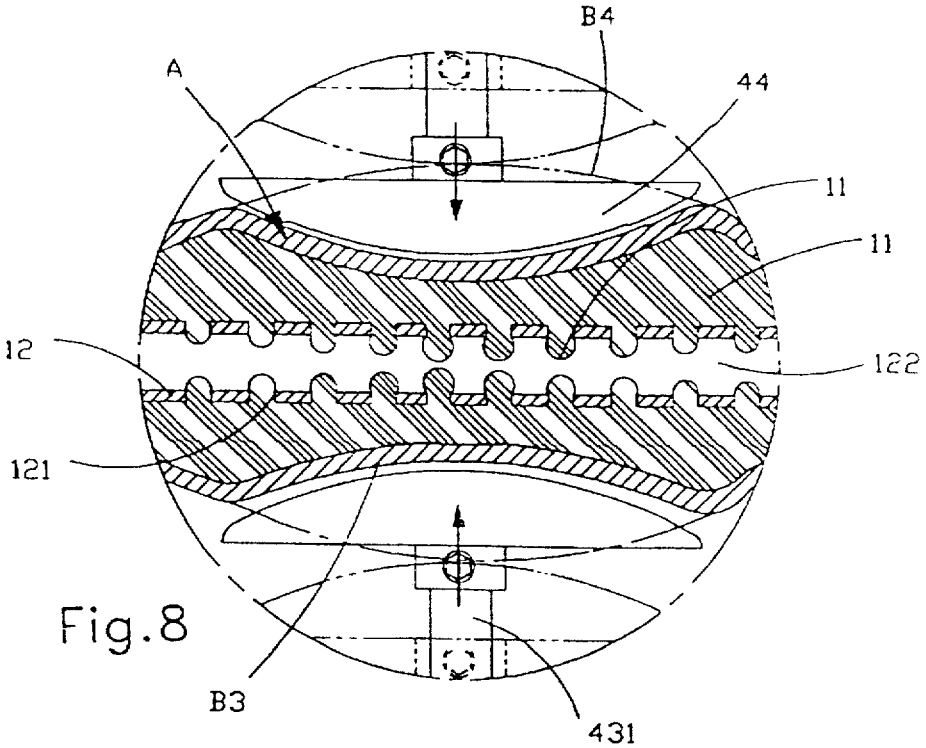
FIG. 8 is an enlarged sectional view showing the second style embossed pipe wall units of the present invention being swaged by the oil pressure punching head of the circularly swaging apparatus.

When an embossed pipe A having filled therein the die core 1 is placed in a circularly swaging apparatus 2, the positioning seats 3 and 30 are firstly moved for adjustment to the positions for clamping the embossed pipe A, and the omnidirectional oil pressure punching heads 33 together clamp the two ends of the embossed pipe A to render it to be corrected to get the proper position; meantime, the portions on the embossed pipe A to be swaged are all naked at the swage processing seats 4, 40, 401, 402 and 403 which can be moved for adjustment immediately to be aligned with the portions on the embossed pipe A to be swaged, FIG. 7 shows that the pipe wall portions B2 on the embossed pipe A correspond to the swage processing seats 4, 401 or 403 shown in FIG. 6, and a plurality of punching heads 45 of suitable shape are provided on the respective plug rods 431 of the oil pressure cylinders 43 in appropriate angular positions in a radiant array and being directed to the centers of the annuli respectively to thereby swage the pipe wall portions B2 into the concaved pipe wall units B1; relatively, FIG. 8 shows the plug rods 431 in the swage processing seats 40, 402 of FIG. 6 are also provided with punching heads 44 of the shape required for processing the pipe wall portions B4 on the embossed pipe A to swage them into the concaved pipe wall units B3; the amount and disposing angles of the concaved pipe wall units B1 and B3 to be shaped for each section of pipe portions shall be known firstly, the required swage processing seats 4, 40, 401, 403 or 402 are mounted in the slide way 22, then the punching heads 44, 45 of suitable shape are mounted and are forwarded, so that the wall units B1 and B3 are subjected to axial swaging pressures respectively and synchronically, thus the concaved pipe wall units B1 and B3 of the required shapes can be formed; the solid plastisol 11 in the shaped concaved pipe wall units B1 and B3 is compressed in multiple directions by the concaved pipe wall units B1 and B3 being swaged, therefore, the bottom layer of the solid plastisol 11 is extruded through the meshes 121 on the holding pipe 12 to the interior of the central pipe hole 122 of the holding pipe 12, such that the stress on the concaved pipe wall units B1 and B3 is sufficiently absorbed thereby, and the concaved pipe wall units B1 and B3 and the remaining wall portions therebetween can be supported and strengthened, and can avoid unnormal deformation following depressing of the concaved pipe wall units B1 and B3; next, the oil pressure punching heads 44, 45 are retracted, and in turn the oil pressure punching heads 33 in the positioning seats 3 and 30 are retracted, so that the shaped embossed pipe B can be removed, the solid plastisol 11 in the shaped embossed pipe B can be slightly heated under the melting point of the plastisol 11 to thereby melt the same slowly for separating from the wall of the pipe hole, then draw the holding pipe 12 out to remove the die core 1 therewith, now the embossment on the wall of the pipe hole of the shaped embossed pipe B can be revealed, the process for swaging and forming the concaved wall units of the metallic embossed pipe of the present invention thus is completed.

By using the method of the present invention stated above, the punching heads can be substituted by other styles of punching heads, so that an embossed pipe can be formed with independent embossment of bamboo leaves, skin of a tree or a tortoise shell etc., thus swaged metallic pipe with high strength and art value can be obtained.

I claim:

1. A method for swaging concave wall units on an embossed metallic pipe comprising the following steps:

A constructing a die core from a hollow holding pipe with a plurality of openings in an outer wall thereof, said openings are in communication with a central pipe hole of said holding pipe;

B. covering said holding pipe with a layer of plastic film;

C. inserting said die core comprising said holding pipe covered with said layer of plastic into a pipe hole of said embossed pipe;

D. filling a space between said plastic film and said embossed pipe with melted plastisol, said central pipe hole of said holding pipe remains open due to said layer of plastic, said melted plastisol thereafter solidifying to a deformable solid;

E. said embossed pipe with said die core is mounted in a swaging apparatus, two positioning seats are used to secure and to adjust positions of two ends of said embossed pipe;

F. a plurality of swage processing seats generate a plurality of radial and inward pressing forces from a plurality of punching heads, thereby forming concave shapes in a wall of said embossed pipe, said plastisol absorbing some of said forces by being forced through said openings in said holding pipe to said pipe hole of said holding pipe;

G. heating said embossed pipe to again melt said plastisol; and

H. removing said die core and said melted plastisol from said pipe hole of said embossed pipe.

2. The method for swaging concave wall units on an embossed metallic pipe as claimed in claim 1 wherein:

said plastisol that fills said space between said plastic film and said embossed pipe in said die core includes an additive, said additive has a grain size small enough so that said additive is able to pass through said openings.

3. The method for swaging concave wall units on an embossed metallic pipe as claimed in claim 2 wherein:

said additive is silicon sand.

4. The method for swaging concave wall units on an embossed metallic pipe as claimed in claim 2 wherein:

said additive is iron sand.

5. The method for swaging concave wall units on an embossed metallic pipe as claimed in claim 2 wherein:

said additive is steel balls.

* * * * *